US005508480A

United States Patent [19]

Quinlan

[11] Patent Number: 5,508,480

[45] Date of Patent: Apr. 16, 1996

[54] MODULAR ELECTRICAL SWITCH AND SWITCHING ASSEMBLY FOR INDUSTRIAL ELEVATORS

[75] Inventor: Ronald D. Quinlan, Pacific, Mo.

[73] Assignee: JPB Enterprises, Inc., St. Louis, Mo.

[21] Appl. No.: 126,994

[22] Filed: Sep. 24, 1993

[51] Int. Cl.[6] ..... H01H 1/18; H01H 9/26

[52] U.S. Cl. ..... 200/16 A; 200/1 R; 200/17 R; 200/18; 200/527; 200/50 C

[58] Field of Search ..... 200/1 R, 1 B, 200/16 R, 16 A, 6 R, 6 C, 16 D, 17 R, 18, 238, 239, 240, 241, 242, 243, 527, 528, 253, 277.1, 50 C

[56] References Cited

U.S. PATENT DOCUMENTS

| | | | |
|---|---|---|---|
| 1,763,649 | 6/1930 | Goetz | 200/24 |
| 2,879,359 | 12/1956 | Pearson | 200/164 |
| 3,187,130 | 6/1965 | Bye et al. | 200/67 |
| 3,539,749 | 11/1970 | MacPheat | 200/159 |
| 3,858,021 | 12/1974 | Brandlein | 200/164 |
| 4,012,612 | 3/1977 | Loomba | 200/61.58 B |
| 4,227,238 | 10/1980 | Saito | 361/415 |
| 4,313,041 | 1/1982 | Ohashi | 200/6 R |
| 4,501,940 | 2/1985 | Suzuki | 200/16 A |
| 4,565,912 | 1/1986 | Glenn | 200/157 |
| 5,047,603 | 9/1991 | Pardini | 200/253 |
| 5,063,276 | 11/1991 | Woodard | 200/529 |

FOREIGN PATENT DOCUMENTS

| | | |
|---|---|---|
| 330355 | 6/1930 | United Kingdom . |
| 418051 | 10/1934 | United Kingdom . |
| 554086 | 6/1943 | United Kingdom . |
| 812626 | 4/1959 | United Kingdom . |
| 820167 | 9/1959 | United Kingdom . |
| 969841 | 9/1964 | United Kingdom . |

OTHER PUBLICATIONS

Courion Industries "Leadership" Brochure Sep., 1991.
Photographs of Peelle 0355067 UB–1A Interlock & Zone Switch and Peelle 0367 23 Jun. 1993.
Zone Contactor 5 make & 1 break contacts The Peelle Company Brochure 1 Mar. 1953.

*Primary Examiner*—Kristine L. Kincaid
*Assistant Examiner*—Michael A. Friedhofer
*Attorney, Agent, or Firm*—Herzog, Crebs & McGhee

[57] ABSTRACT

A modular electrical switch provides a wiping or shearing action upon closing and opening thereof. A contact carrier disposed within a housing linearly carries a movable contact into engagement with a stationary contact. The contact carrier is guided by movable slide plates disposed on either side thereof and movable along with the contact carrier as a contact assembly. The guide plates also provide pivot recesses for pivot bosses of the contact carrier. The contact carrier is constrained to linear motion up to the point of contact between the movable contact and the stationary contact by a cam trace in the housing. After contact between the movable contact and the stationary contact, the contact carrier reaches a pocket defined by the cam trace, ceases linear movement and upwardly pivots to provide a wiping action between the movable contact and the stationary contact. Immediately upon reversed, pivoting and linear motion of the contact carrier a shearing action is provided between the movable contact and the stationary contact. A plurality of such modular switches are utilized in a freight elevator interlock system for regulating the opening and closing of the various doors and carriage of the freight elevator. A common sliding actuator controls the modular switches regardless of the orientation of the respective switches within the housing.

7 Claims, 9 Drawing Sheets

MODULAR ELECTRICAL SWITCH AND SWITCHING ASSEMBLY FOR INDUSTRIAL ELEVATORS

FIELD OF THE INVENTION

The present invention relates generally to electrical switches and to switching assemblies utilizing such electrical switches in connection with freight elevators and, more particularly, to electrical switches of the wiping action type and switching assemblies utilizing the same to control the opening and closing of freight elevator gates and doors.

BACKGROUND OF THE INVENTION

Freight elevators which are used in warehouses, commercial buildings, and various industrial applications, differ from general purpose or passenger elevators in several respects. Although the actual carriage or car of both types of elevators are essentially the same, neglecting the size and decor thereof, the doors, and mechanisms for the operation of the doors to the elevator differ. Furthermore, freight elevators are generally subject to different codes and regulations.

Generally, passenger elevators have two sets of horizontally-opening doors. One set of doors moves with the elevator carriage while the other set of doors is fixed to the hoistway opening on the respective floor. Both sets of doors include left and right halves that join together along a vertical line and thus horizontally outwardly open. When the passenger elevator carriage reaches the respective floor, both sets of doors then open to allow passengers to enter and egress.

In contrast, freight elevators generally have vertically opening doors. The vertically opening doors may be either a single set of doors affixed to the hoistway opening of the respective floor or a single vertically opening door. The single set of vertical doors includes two half doors meeting at a horizontal line and respectively opening in a vertical bi-directional manner while the single door moves vertically. The elevator carriage generally includes a single vertically-moving gate or door which travels along with the elevator carriage. Both the passenger elevators and freight elevators include systems therein which control the opening and closing of the respective doors. Various regulations and safety codes require that such doors positively open and close.

In the case of freight elevators, safety codes require that the doors to the hoistway physically lock when the elevator is not present at the particular floor. Therefore, all of the doors to the hoistway need to be locked when the elevator is in motion. When the elevator stops at any individual floor, then, and only then, should the particular set of doors to the that particular floor be able to open. This is generally accomplished by providing a positive locking mechanism at each floor that is also electrically interlocked so that in the case of some possible action that would unlock a door at a particular floor which should not be unlocked, the elevator carriage will stop and no other action may take place. Such prior art locking mechanisms are thus located at each floor.

It is necessary for the contacts in the safety circuit to positively open when needed and freight elevators are generally located in areas which are not always clean, or are subject to becoming dirty quickly, with loading and unloading of various equipment and the like. In this regard, European safety codes specify that such contacts must open even if they are welded shut.

Most prior art interlock systems utilize spring action to positively make contact or "interlock" and another force or positive mechanism is used to break contact. However, such positive mechanisms are not capable of providing the necessary shearing action that may be required to separate the contacts should the contacts become joined together either through welding or the like. Thus, it is desirable to have an interlock system which is capable of positively making and breaking contact in all situations.

Furthermore, prior art interlock systems or ladder switches are composed of many individual components. If it is necessary to repair or change the components due to breakage or corrosion the entire assemblage must be taken apart. Due to the general location of the interlock system within the elevator hoistway, it is generally very difficult to reach and/or effect the modifications.

It is thus desirable to provide an interlock switch which is easy to effect repair.

SUMMARY OF THE INVENTION

The present invention addresses the problems and concerns of the prior art by providing an electrical switch that creates a wiping action of the contacts during initial contact and during the opening of the switch. Such wiping action is accomplished by a pivoting motion of a sliding contact carrier that only occurs after initial connection of the contacts. The return of the sliding contact carrier provides a wiping, shearing, or breaking motion during reverse pivoting after initiation of contact breaking.

The movable contact carrier assembly includes a cam and pivot that are guided by slide plates disposed on either side of the contact carrier. Each slide plate includes a pivot recess to allow the contact carrier to pivot. The contact carrier includes a pair of pivot bosses received in the pivot recesses. The pivoting motion of the contact carrier is initially constrained by a cam trace on the upper housing. The cam trace defines a pocket at the end of the trace. As the contact carrier is moved forward into the contact position, the contact carrier is constrained to linear movement by the cam trace. At the point of contact of the movable contact with the stationary contact, the contact carrier is caused to pivot upwardly into the pocket defined at the end of the cam trace. The movable contact, carried by the contact carrier, thus moves transverse to the initial direction of movement of the contact carrier, or upwardly against the stationary contact to provide the wiping action.

Upon opening or breaking contact, the contact carrier reverses its path to provide a shearing action of the movable contact against the stationary contact. Once the contact carrier is clear of the pocket in the cam trace the downward movement of the movable contact relative to the stationary contact ceases, and transverse motion begins. A spring assists in maintaining contact pressure between the movable contact and the stationary contact upon closure.

In one form thereof, the present switch comprises a housing, a stationary contact disposed in the housing, a movable contact disposed in the housing, and a contact carrier. The contact carrier carries the movable contact into and out of electrical engagement with the stationary contact, the housing defining a path of travel along which the contact carrier moves. Means for pivoting the contact carrier at a point of contact of the movable contact with said stationary contact is provided to effect a wiping action between the movable contact and the stationary contact.

In another form there is provided an electrical switch comprising, a housing having an upper portion and a lower portion with the upper and lower portions joining at a horizontal plane. A first stationary contact is disposed in the housing, and a second stationary contact is disposed in the housing and spaced from the first stationary contact. A two-ended movable contact and a contact carrier are movably disposed in the housing. The contact carrier is adapted to carry the two-ended movable contact into and out of electrical engagement with the first and second stationary contacts to complete an electrical circuit therebetween. The contact carrier includes a leg extending from the lower portion of the housing for receiving an actuating thrust. The housing defining a path of travel along which the contact carrier linearly moves. Further included is means for pivoting the contact carrier after a point of contact of the two-ended movable contact with the first and second stationary contacts to effect a wiping action between the two-ended movable contact and the first and second stationary contacts. The pivoting means includes a first and second boss integrally formed on opposite sides of the contact carrier, and a first and second guide plate disposed on opposite sides of the contact carrier. The first and second guide plates respectively having a first and second pivot recess for receiving the first and second bosses such that the contact carrier is pivotally disposed thereon. A cam trace is disposed in the path of travel and formed in a lower surface of the upper portion, the cam trace defining a recess at an end of the travel path and constraining the contact carrier from pivotal movement until the contact carrier has reached a predetermined travel distance. The actuating thrust linearly moves the contact carrier along the path of travel such that the two-ended movable contact engages the first and second stationary contacts at the predetermined travel distance wherein the contact carrier ceases linear movement, the recess then permitting the contact carrier to pivot to effect a wiping action between the two-ended movable contact and the first and second stationary contacts.

In another form of the invention, the present invention provides an interlock assembly for freight elevator doors that incorporates an array of the present modular electrical switches. The modular switches are mounted within a housing and are actuated by a common sliding actuator in response to a cam drive. Movement of the common sliding actuator provides an off-center or external thrust that is transferred to the switch.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings.

It is noted, however, that the appended drawings illustrate only typical embodiments of this invention and is therefore not to be considered limiting of its scope, for the invention may admit to other equally effective embodiments. Reference the appended drawings, wherein.

DESCRIPTION OF THE PREFERRED EMBODIMENT

Prior Art

Figure 1:
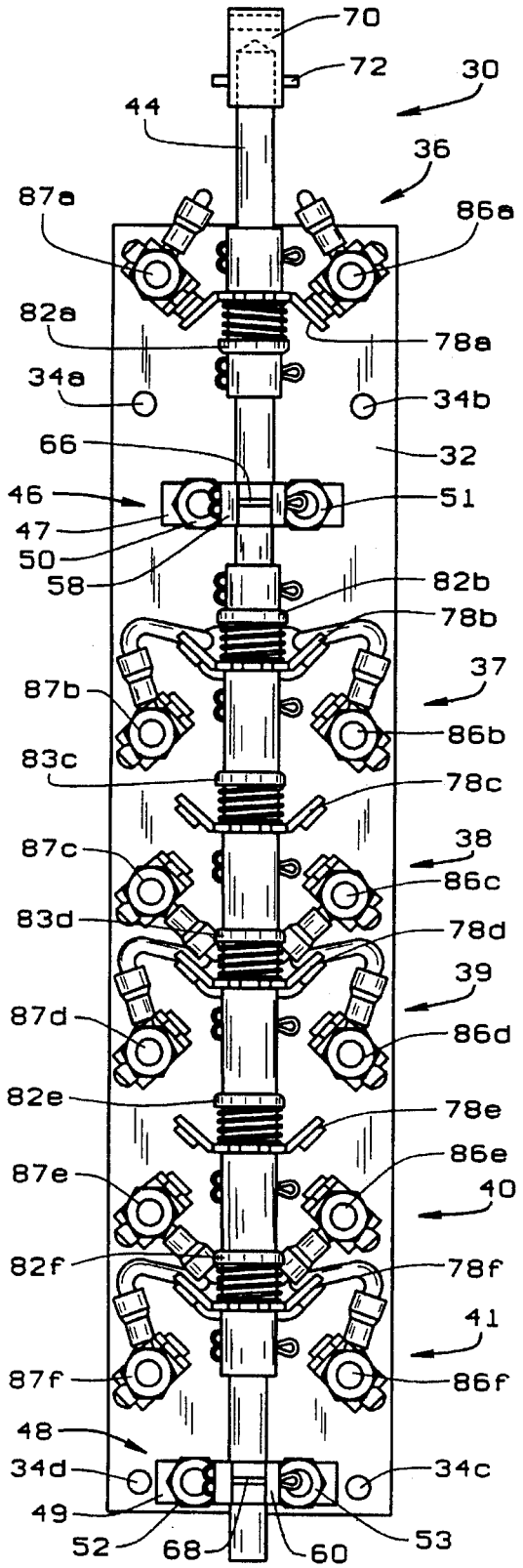
FIG. 1 PRIOR ART
FIG. 1 is a top plan view of a prior art switching assembly, or ladder switch, utilized in freight elevators typically having vertical bi-parting doors, the switching assembly depicted in a first position.

Referring now to FIGS. 1–4 there is shown a prior art ladder switch generally designated 30 of the type currently being utilized in the freight elevator industry to operate the associated gates and doors, currently constituting the state of the art in the industry. Ladder switch 30 includes an elongated mounting board 32 having four spaced apart holes 34*a–d* that permit mounting board 32 switch assemblies 36, 37, 38, 39, 40, 41, are secured to mounting board 32 longitudinally adjacent to one another. An elongated, slidable actuator rod 44 is centrally positioned onto mounting board 32 and removably constrained to longitudinal movement thereto by two clip assemblies 46, 48. As more easily perceivable by reference to FIG. 3, clip assemblies 46, 48 each consist of a respective bracket 47, 49, secured to mounting board 32 via nut and bolt pairs, 50, 51, and 52, 53. Each bracket 47, 49 respectively includes two spaced apart, upstanding flanges 54, 55, and 56, 57, each flange 54-57 having a bore therethrough (not shown).

Received between flange pairs 54, 55 and 56, 57, are respective U-brackets 58, 60 that are secured thereto by respective cotter pins 66, 68. Sliding actuator rod 44 is thus slidably received within U-brackets 58, 60 which also function as a retainer for sliding actuator rod 44 such that sliding actuator rod 44 may limitedly longitudinally travel back and forth therein. U-brackets 58, 60 also provide a bearing surface for sliding actuator rod 44.

Figure 3:
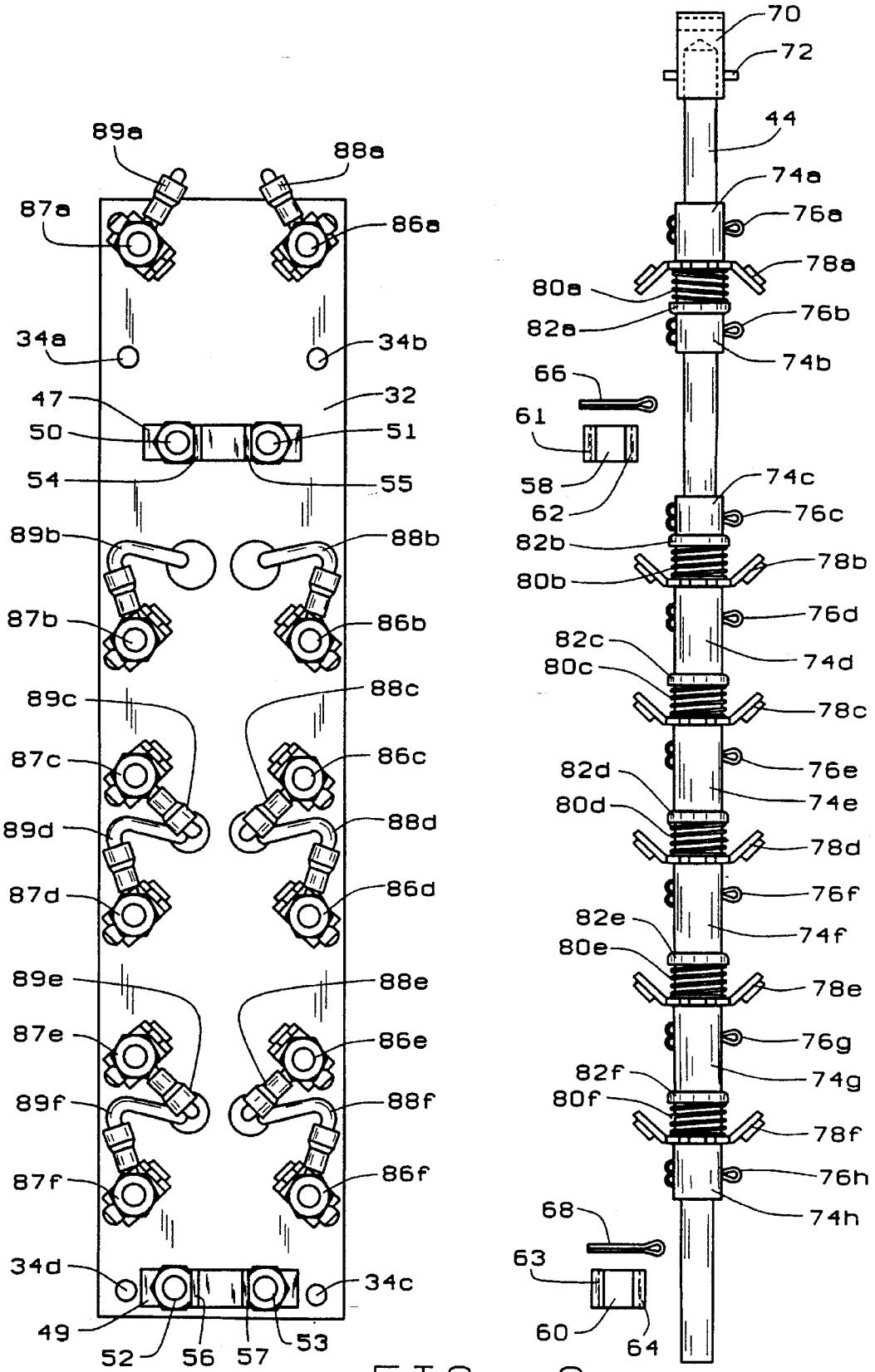
FIG. 3 PRIOR ART
FIG. 3 is a partially exploded top plan view of the prior art switching assembly of FIG. 1 with the actuating rod uncoupled from the contact board.
Figure 4:
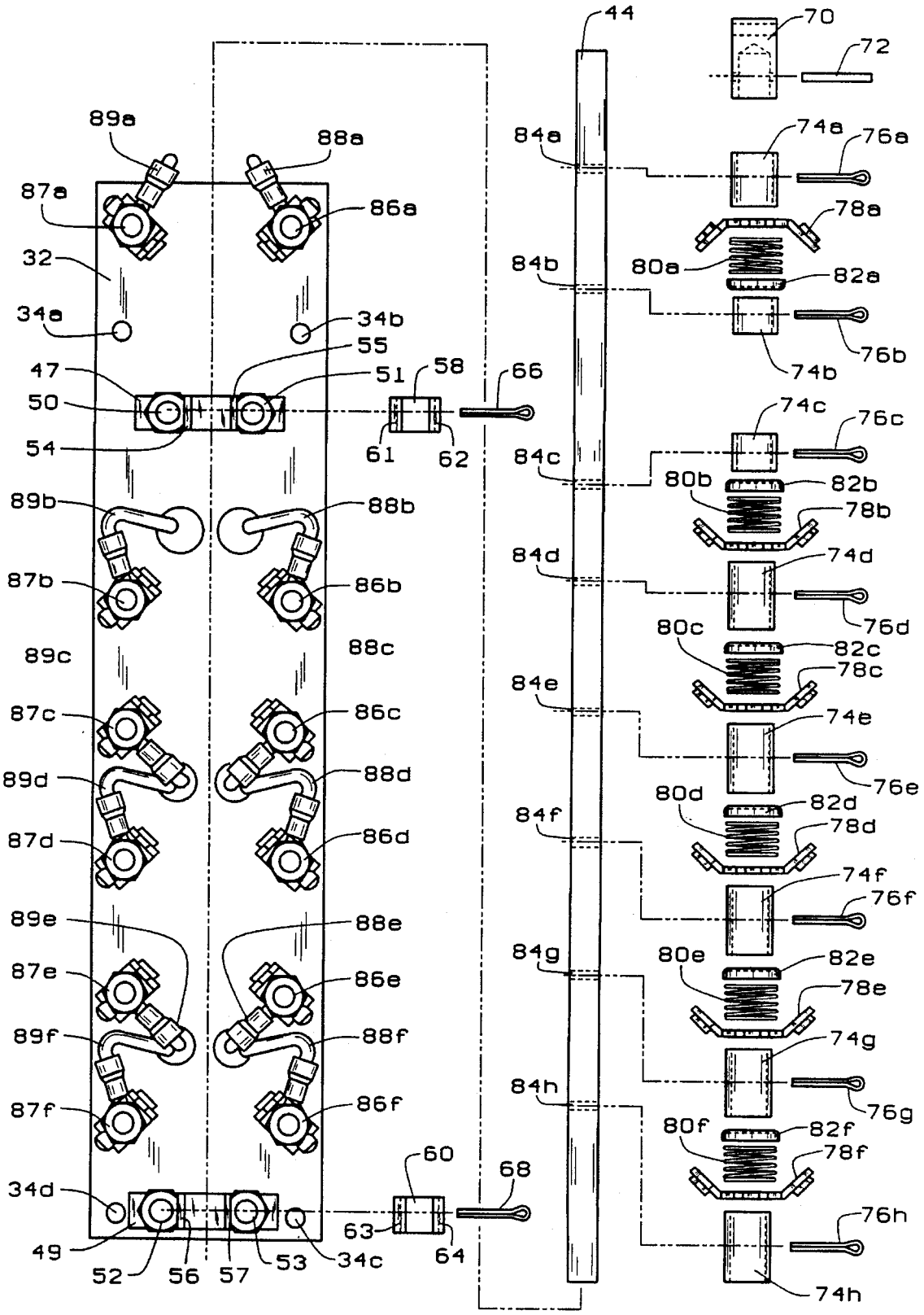
FIG. 4 PRIOR ART
FIG. 4 is an exploded view of the actuator rod assembly of the prior art switching assembly of FIG. 1 showing the various components and placement thereof on the contact board.

As best discerned in FIGS. 3 and 4, a movable contact portion of each switch assembly 36-41 is disposed on sliding actuator rod 44. Disposed on one end of sliding actuator 44 is an end cap 70 secured thereto by a pin 72 that extends through end cap 70 and sliding actuator rod 44. End cap 70 provides the interface with other mechanisms when the elevator approaches and stops at the desired floor, to move sliding actuator rod 44 accordingly. The movable contact portion of switch assembly 36 essentially consists of a two-ended contact 78*a* that is longitudinally movable back and forth on sliding actuator rod 44. However, the longitudinal travel distance of two-ended contact 78*a* is limited. A tubular sleeve 74*a* is disposed on one axial end of two-ended contact 78*a*. Tubular sleeve 74*a* is removably secured to sliding actuator rod 44 by a cotter pin 76*a* that extends through diametrically opposed bores (not shown) in tubular sleeve 74*a* and bore 84*a* in sliding actuating rod 44. Two-ended contact 78*a* thus abuts one end of tubular sleeve 74*a* such that tubular sleeve 74*a* provides a stop or limiter therefor. Two-ended contact 78*a* is resiliently limited on the other axial end by a spring 80*a*, a spring retainer cup 82*a*, and a tubular sleeve 74*b*. Tubular sleeve 74*b* is removably secured to sliding actuator rod 44 by a cotter pin 76*b* that extends through diametrically opposed bores (not shown) in tubular sleeve 74*b* and bore 84*b* in sliding actuating rod 44. Spring 80*a* along with spring retainer cup 82*a* are disposed between two-ended contact 78*a* and tubular sleeve 74*b* such that two-ended contact 78*a* may compressingly longitudinally travel in one direction on sliding actuator 44. This creates a biasing force against two-ended contact 78*a* when two-ended contact 78*a* engages right and left contact assemblies 86*a* and 87*a*, respectively (see FIG. 1).

Likewise, the movable contact portion of switch assemblies 37-41 include respective two-ended contacts 78*b–f* that are disposed between respective tubular sleeves 74*c–h*, springs 80*b–f*, and spring retainers 82*b–f*. In the same manner as described above, tubular sleeves 74*c–h* are removably secured to sliding actuator rod 44 via respective cotter pins 76*b–h* which extend through diametrically opposed bore (not shown) in the respective tubular sleeve, and respective bores 84*b–h* in sliding actuator rod 44. Furthermore, each two-ended contact 78*b–f* is limitedly longitudinally movable along sliding actuator rod 44, this being accomplished by abutting the respective tubular sleeve, and resiliently biased by the respective spring on the other end.

Each movable contact portion of switch assemblies 36-41 is movable into and out of engagement with the stationary contact portion of switch assemblies 36-41, respectively constituting stationary contact pairs, 86*a*/87*a*, 86*b*/87*b*, 86*c*/87*c*, 86*d*/87*d*, 86*e*/87*e*, and 86*f*/87*f*, thereby completing the electrical circuit therebetween. As best seen in FIGS. 3 and 4, each stationary contact, 86*a–f*, and 87*a–f*, respectively, includes an associated electrical lead 88*a–f*, and 89*a–f*, for connection to the other various components associated with the control of freight elevators. It should here be appreciated that it is not necessary for all of the switch assemblies 36-41 to be open or closed at the same time, as the function of each respective switch assembly may dictate that some be open while at the same time others be closed, and vice versa.

Figure 2:
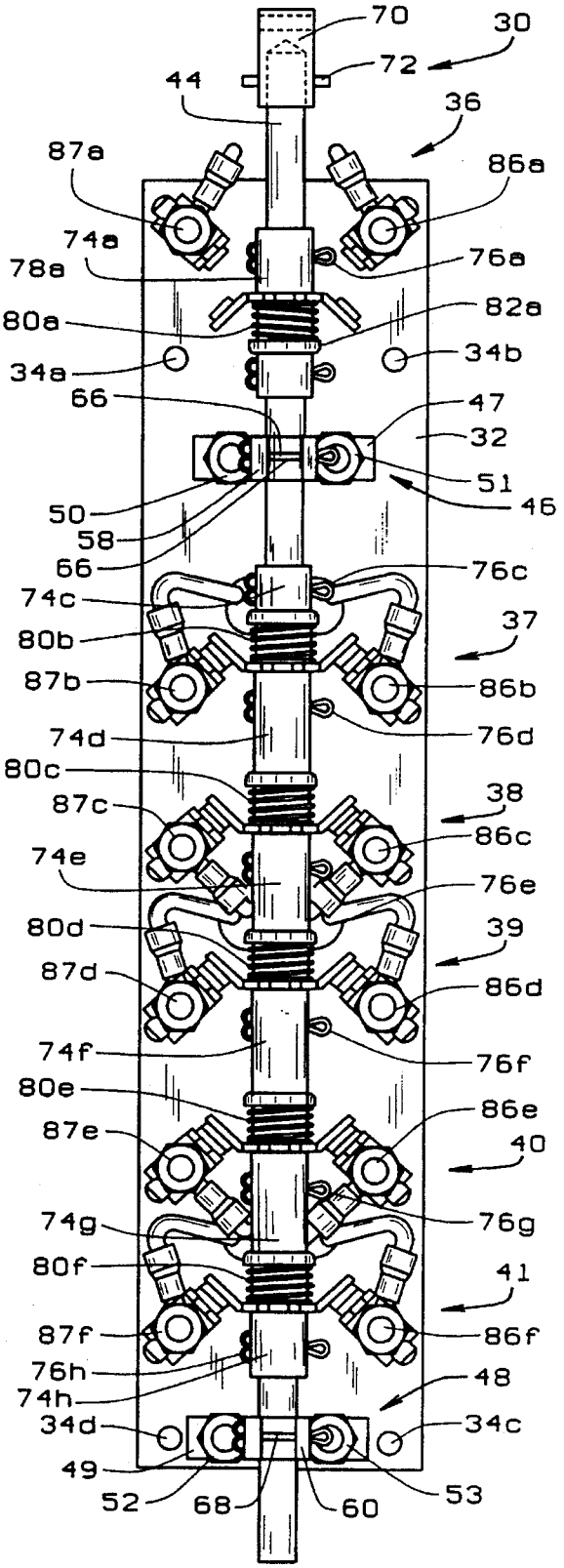
FIG. 2 PRIOR ART
FIG. 2 is a top plan view of the prior art switching assembly depicted in a second position.

In short, ladder switch 30 operates through the sliding of actuator rod 44. When the actuator rod 44 is in the position depicted in FIG. 1, only the top switch assembly 36 is closed, while the other switch assemblies 37-41 are open. The sliding of actuator rod 44 as depicted in FIG. 2 opens switch 36 while at the same time closing switches 37-41.

Thus, it can be appreciated from the foregoing that the prior art ladder switch 30 is quite impractical in several respects. Since the ladder switch is mounted in the hoistway of the elevator, it is not only difficult to reach, but even more difficult to effect repairs. Should a contact become welded, corroded, or otherwise, thereby necessitating the replacement thereof, the entire sliding actuator rod 44 must be initially removed. This is accomplished by first removing U-brackets 58, 60. Each tubular sleeve must then be removed until the nonoperative contact is reached. Obviously, springs, cotter pins, tubular sleeves, and spring retainers have been removed and must be retained for reassembly. It is therefore difficult and tedious to effect repairs of current state of the art, prior art ladder switches. Thus, in many cases the entire sliding actuating rod and switch assemblies contained thereon is replaced, making such repair more costly than need be.

PRESENT EMBODIMENT

Referring now to FIGS. 5–9 there is shown an industrial or freight elevator interlock switch assembly generally designated 100 according to the present invention. It should be appreciated that interlock switch performs the function of the prior art ladder switch, and is placed within the elevator hoistway at each floor at which the elevator stops. The interlock assembly 100 is mechanically connected to the elevator doors and carriage to monitor the position of each, and electrically connected to the motors that operably drive the elevator doors and carriage. Thus, interlock assembly 100 monitors the position of the doors and carriage such that the carriage will not be able to move when the doors are not closed and locked, but allows operation of the carriage when the doors are locked. Interlock switch 100 includes an elongated housing 102 preferably formed of a metal such as steel. Housing 102 defines an elongated or longitudinal channel 103 (see FIG. 8) in which is disposed an elongated or longitudinal actuator plate 104 preferably formed of a glass-filled plastic. Disposed at one end of housing 102 is a cam 108 which is secured to and pivotable about a rotating rod 110 by a pin (not shown).

Figure 8:
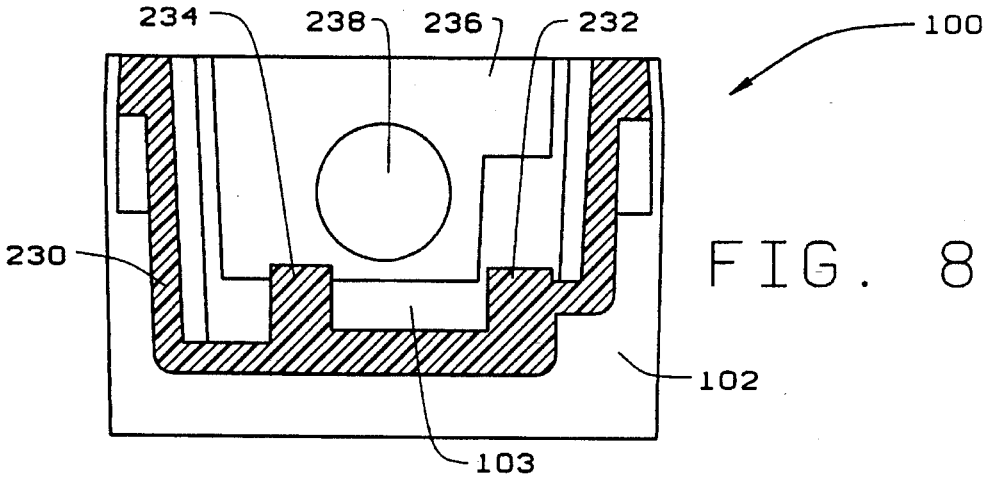
FIG. 8 is a sectional view of the present switching assembly with all of the modular switches removed taken along line 8—8 of FIG. 7.

Specifically referring to FIG. 8, a longitudinal view of housing 102 is shown with all of the modular switches removed for clarity. Channel 103 is defined by an interior longitudinal, generally U-shaped wall 230 that extends along the longitudinal length of housing 102. Wall 230 includes two integrally formed longitudinally extending bosses 232 and 234 onto which the modular switches are mounted. By elevating the modular switches, this allows the carrier legs 114 to freely extend into the actuator plate 104 such that the actuator plate 104 mechanically mates with the carrier legs 114 for actuation of the modular switches by the actuator plate 104. A bore 238 that may be threaded is located in end wall 236. Bore 238 thus allows assembly 100 to be mounted onto a conduit (not shown) and/or permit electrical wires or leads (not shown) to connect to and from the modular switches.

Figure 5:
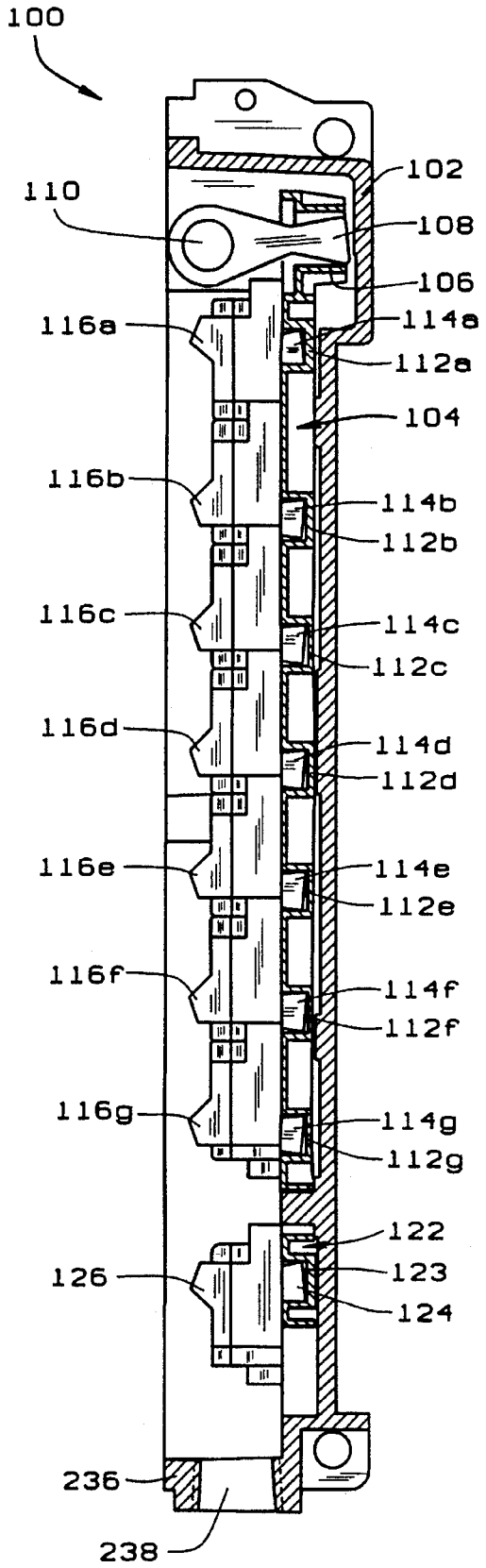
FIG. 5 is a sectional view of the present switching assembly depicting the plurality of modular switches in a mid-stroke position.
Figure 6:
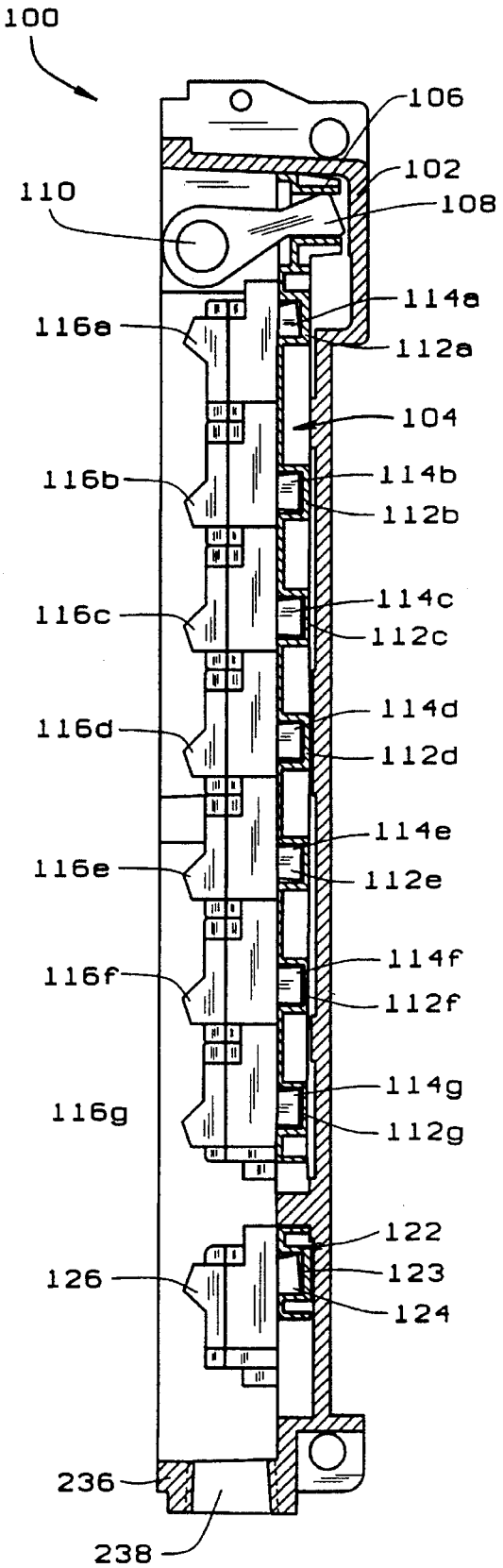
FIG. 6 is a sectional view of the present switching assembly depicting the plurality of modular switches in either a fully open or fully closed position.
Figure 7:
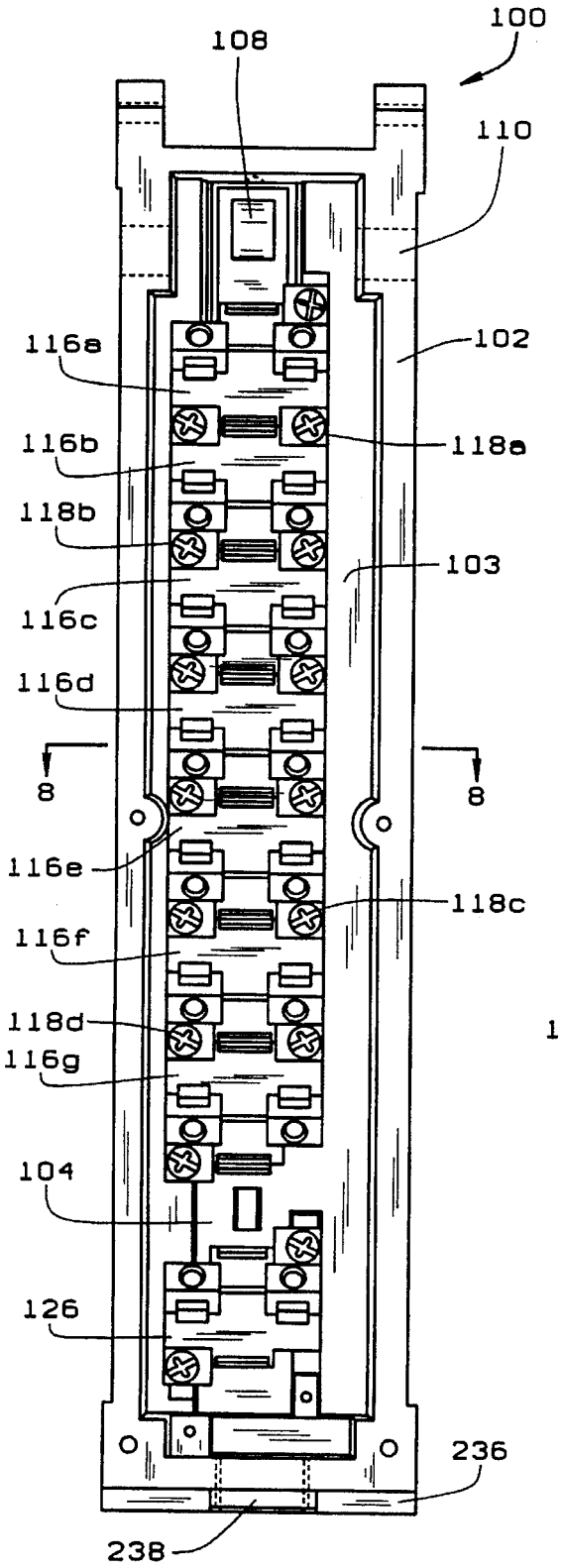
FIG. 7 is a top plan view of the present switching assembly of FIG. 5.

Rotating rod 110 is connected to an elevator door actuating mechanism such that when the freight elevator moves to the desired floor, at a certain point in time dictated by the position of the elevator carriage, rod 110 is rotated, thereby causing cam 108 to pivot thereabout. Rod 110 is bi-directional, such that as the elevator carriage arrives and stops at the desired floor and the doors are ready to open, rod 110 rotates in one direction, thereby pivoting cam 108 in the same rotative sense, while when the elevator carriage is ready to leave the floor and the doors are shut, rod 110 rotates in the opposite direction thereby pivoting cam 108 in the same opposite rotative direction. Actuator plate 104 includes a stepped portion or cam recess 106 into which cam 108 extends. Thus, as cam 108 pivots in response to actuator rod 110, actuator plate 104 is limitedly longitudinally movable back and forth within channel 103, controlled by the limited pivotal movement of cam 108. FIG. 6 depicts cam 108 and actuator plate 104 in a fully extended position, which is a door unlocked position that allows the doors to operate but does not allow the carriage to move. When cam 108 is rotated the opposite direction, cam 108 slides actuator plate 104 downwardly, as viewed in the drawings. This position would indicate that the doors are shut and locked, so the carriage is operable and able to move to the desired floor. FIG. 5 depicts cam 108 and actuator plate 104 in a mid-stroke position.

Figure 9:
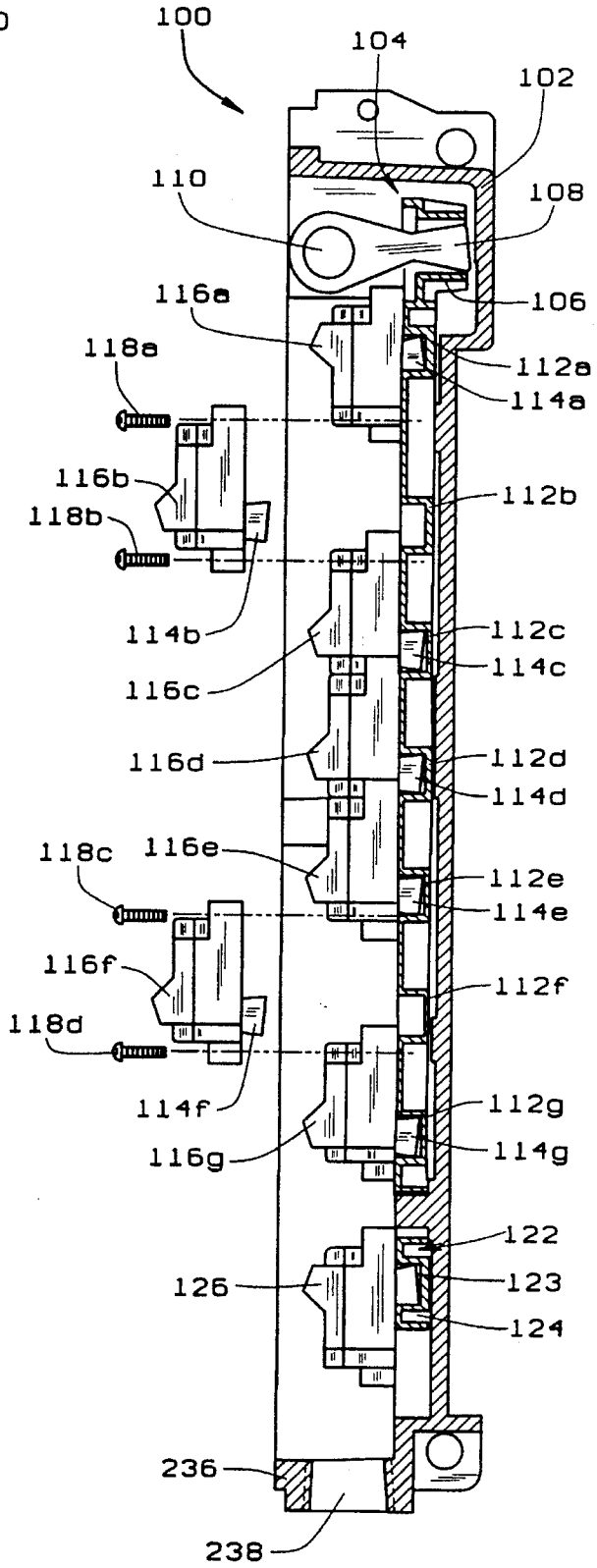
FIG. 9 is a sectional view showing of the present modular switch, depicted in a mid-stroke position.

Actuator plate 104 further includes seven stepped portions or carrier leg recesses 112*a–g*, longitudinally spaced therealong. Disposed above recesses 112*a–g* are seven modular switches 116*a–g* in accordance with another aspect of the present invention. It should here be appreciated that the plurality of modular switches are all identical in form, function, and operation. Thus, although each part of each modular switch has a different number in the Figures, this is only for differentiation of each modular switch and for clarity for the reader. Each modular switch 116*a–g* is mounted to housing 102 by screws or other suitable mounting devices such that the switches straddle channel 103 and thus actuator plate 104. Referring particularly to FIG. 9, Switches 116*b* and 116*f* are shown removed from housing 102 with their associated mounting screws 118*a,b,* and 118*c,d,* respectively, likewise removed to show.

Extending into each recess 112*a–g* from each switch 116*a–g* is a carrier leg 114*a–g* respectively. As detailed hereinbelow, the carrier leg moves within the switch to cause the internal contacts within the switch to meet and break (open and close). Thus, as actuator plate 104 moves in response to cam 108 in response to the position and status of the elevator doors and carriage, so do the respective carrier legs 114*a–g* such that contact is either made or broken in the respective modular switch 116*a–g*.

As can be seen in FIGS. 5–7, 9, switch 116*a* is oriented opposite to the other switches 116*b–g*. This is because switch 116*a* is the main interlock switch that controls elevator operation by locking out all elevator operation if the doors are unlocked. Thus, although switches 116*b–g* control the motors that drive the doors and are open circuited as shown in FIG. 6, such that the same motors will not operate, switch 116*a* is close circuited, enabling operation of the carriage.

Interlock assembly 100 further includes an additional independently actuated switch 126 having a carrier leg 124 disposed within a recess 123 formed in second actuator plate 122. Actuator plate 122 is connected to a cam that moves in response to the upper door of the bi-parting doors. As it could be possible for someone to try to pry open the top panel, the switch thus monitors the same.

The present interlock assembly 100 with its modular switch array, thus makes the replacement of defective switches much simpler and easier, regardless of the mounting location or environment of the assembly. Two mounting screws are removed to extricate any defective switch which can then be just as easily replaced. Furthermore, as described hereinbelow, the modular switches include a housing which protects the contacts within the switch from degradation as a result of corrosion, deposits, and the like.

Figure 10:
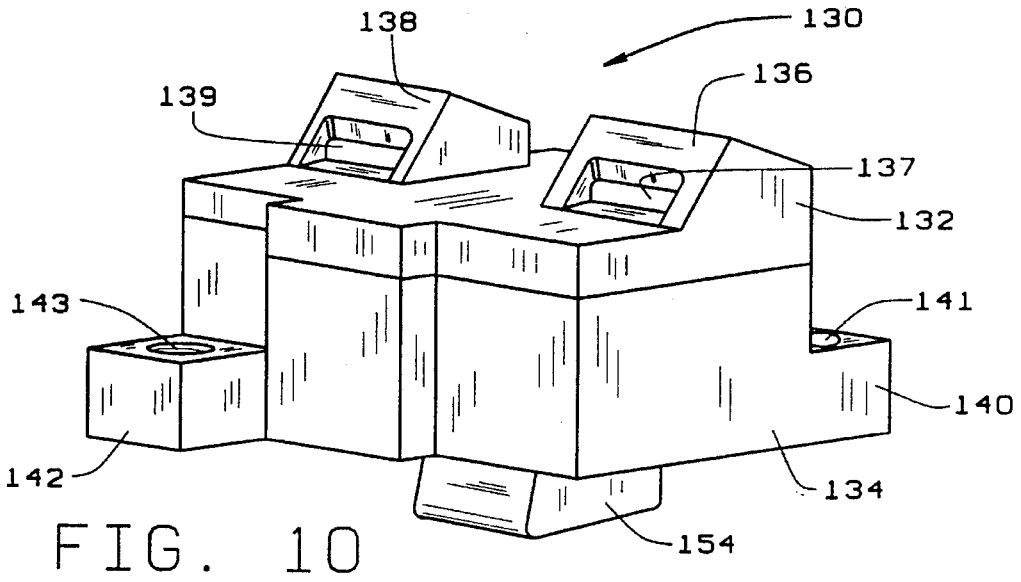
FIG. 10 is an enlarged elevational view of a single modular switch according to the present invention.

A modular switch 130 is depicted in FIG. 10 which is identical to the modular switches 116*a-g,* 126 shown in FIGS. 5–7, 9 and discussed hereinabove with reference to the interlock assembly. Switch 130 includes an upper housing member 132 and a lower housing member 134 which are joined together along an essentially horizontal line. On one side of the outer surface of upper housing member 132 is a raised portion 136 which includes a rectangular opening 137, while disposed on the other side of upper housing member 132 is another raised portion 138 which includes a rectangular opening 139. Rectangular openings 137, 139 permit connection of an electrical lead (not shown) to the stationary contacts disposed within the housing. Lower housing member 134 includes a rectangular screw boss 140 having a bore 141 therethrough for mounting one end of switch assembly 130 via a screw. Diagonally disposed of rectangular screw boss 140 is another rectangular boss 142 having a bore 143 therethrough for mounting the other end of switch assembly 130. An actuating or carrier leg 154 is shown extending from the underside of lower housing 134.

Figure 22:
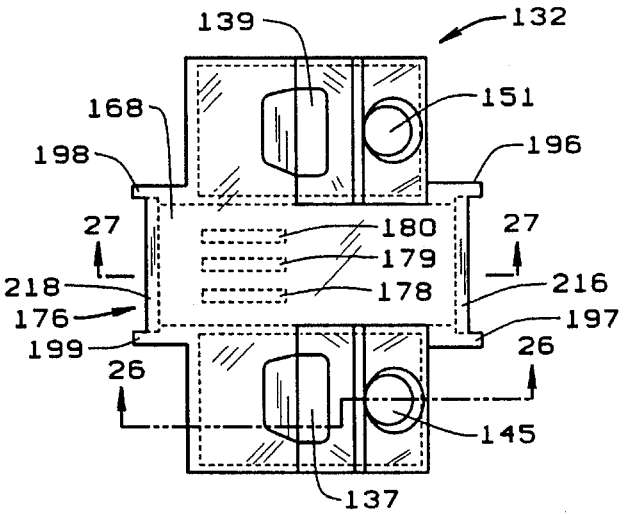
FIG. 22 is a top plan view of the upper housing portion of the modular switch of FIG. 10.
Figure 24:
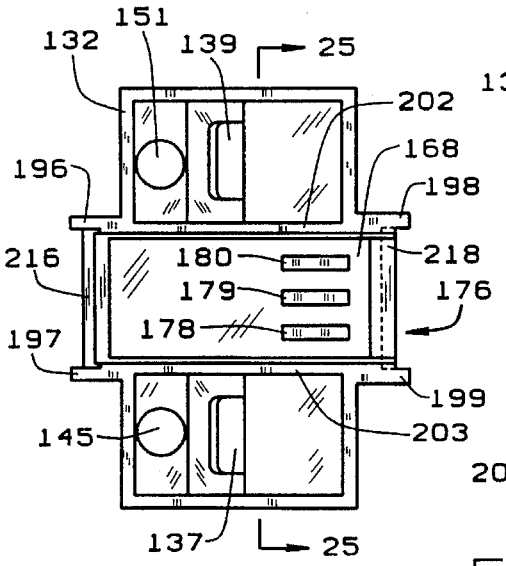
FIG. 24 is a bottom plan view of the upper housing portion depicted in FIG. 22.
Figure 25:
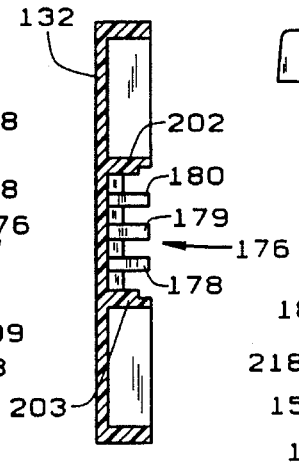
FIG. 25 is a sectional view of the upper housing portion taken along line 25—25 of FIG. 24.
Figure 26:
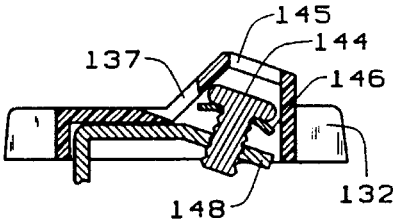
FIG. 26 is a sectional view of the upper housing portion taken along line 26—26 of FIG. 22 showing the stationary contact mounted therein.

Upper housing member 132 is depicted in greater detail in FIGS. 22–25. FIG. 22 shows a top view of upper housing member 132. Adjacent rectangular openings 137, 139 are holes 145, 151 respectively, though which one can tighten wire binding screws, of which only one wire binding screw 144 is shown (see FIGS. 10, 26) in order to securely connect the electrical lead (not shown) to the stationary contact, of which only one stationary contact 148 is shown (see FIGS. 10, 26). With reference to FIG. 26, the connection of an electrical lead is accomplished by inserting an electrical lead (not shown) into opening 137 until the electrical lead is positioned under wire binding screw head 144 and clamp member 146. Wire binding screw 144 is threadedly engaged with stationary contact 148. Wire binding screw 144 is then tightened by inserting an appropriate screwdriver into hole 145 and rotating. Although the opposite side stationary contact is not shown, it is identical to the configuration depicted in FIG. 26 and connected in the same manner.

Figure 23:
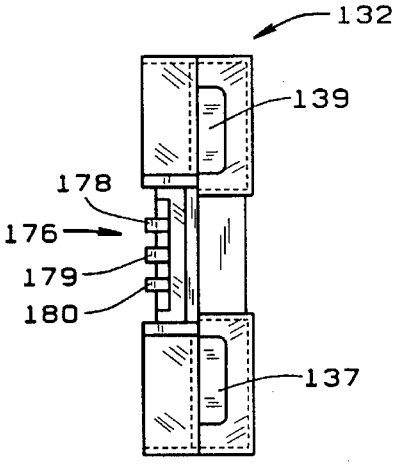
FIG. 23 is a side view of the upper housing portion depicted in FIG. 22.

Additionally referring now to FIG. 24, upper housing member 132 includes two elongated walls 202, 203 that define an upper surface of a channel or travel path cavity 186. At both ends of walls 202, 203 are flanges 196, 197, 198, 199, which provide a locking mechanism to join with the lower housing member 134. Disposed in travel path cavity 186 and extending downwardly from the lower or underside surface of upper housing member 132 is a cam trace 176 defined by three ledges 178, 179, 180. Ledges 178, 179, 180 are also depicted in FIGS. 23, 25, and such ledges define a pocket or recess 168 between the ends of ledges 178, 179,180, and the end of upper housing member 132.

Figure 30:
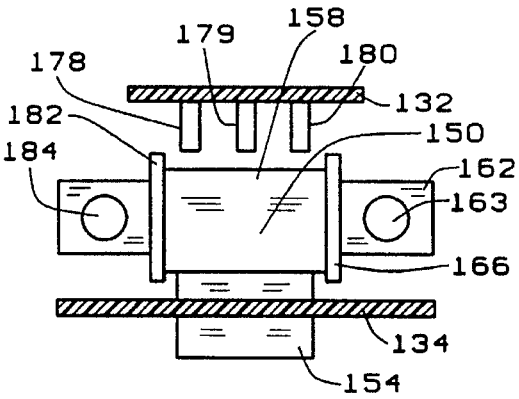
FIG. 30 is an enlarged partial sectional front view of the contact carrier and movable contact.
Figure 21:
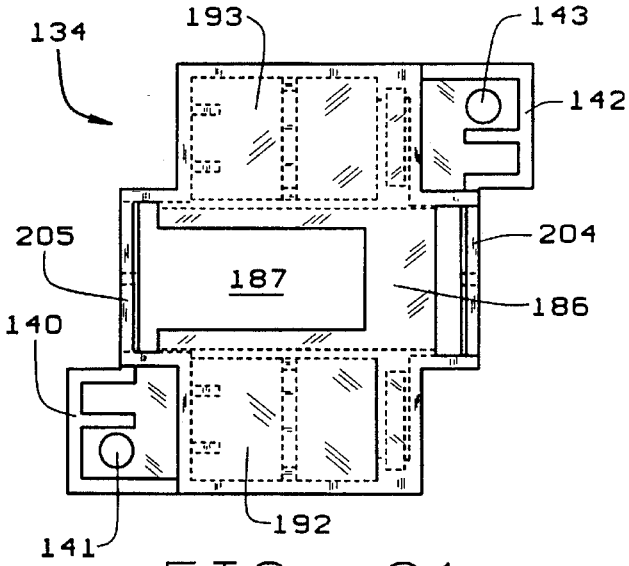
FIG. 21 is a bottom plan view of the lower housing portion depicted in FIG. 18.

Referring now to FIGS. 18–21 lower housing member 134 is shown. Defined within front end wall 204, rear end wall 205, side wall 206, and side wall 207 is the longitudinal travel path 186 for contact carrier 150 and slide plates 166, 182. It should here be appreciated that contact carrier 150, movable contact 162, and slide plates 166, 182 (see FIG. 30) constitute a movable contact assembly that travels within the longitudinal travel path cavity/channel 186. On the lower portion of lower half 134 below travel path cavity 186 is a cutout portion 187 through which leg 154 of contact carrier 150 extends. Disposed on both sides of cavity/channel channel 186 are spaces 192, 193 in which the movable contact 162 travels. Referring to FIG. 30 movable contact 162 is shown transversely extending from contact carrier 150 as both are disposed within the housing.

Figure 19:
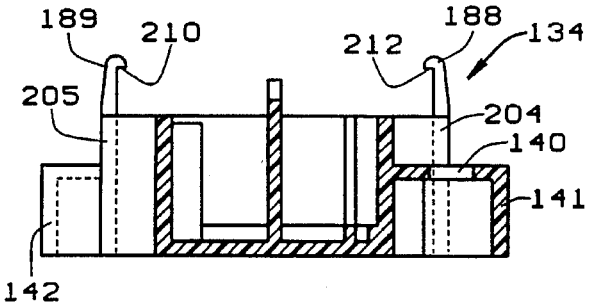
FIG. 19 is a sectional view of the lower housing portion taken along line 19—19 of FIG. 18.
Figure 20:
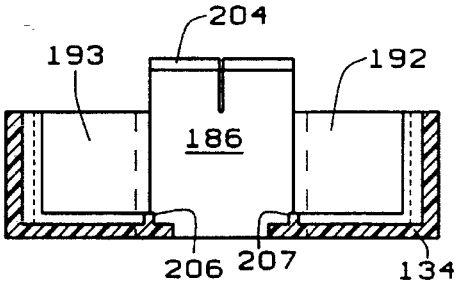
FIG. 20 is a sectional view of the lower housing portion taken along line 20—20 of FIG. 18.

As best seen in FIG. 19 walls 204, 205 terminate in prongs 188, 189 that define respective surfaces 210, 212. When upper housing half 132 is to be joined with lower housing half 134, stepped edge 218 is inserted under prong 189. The union of upper housing half 132 with lower housing half 134 is best seen in any one of FIGS. 12–17. Angled edge 216 is then forced downwardly onto prong 188 which rides up angled edge 216 to rest thereon. Thus, a snap-fit holds the two housing halves together.

Figure 11:
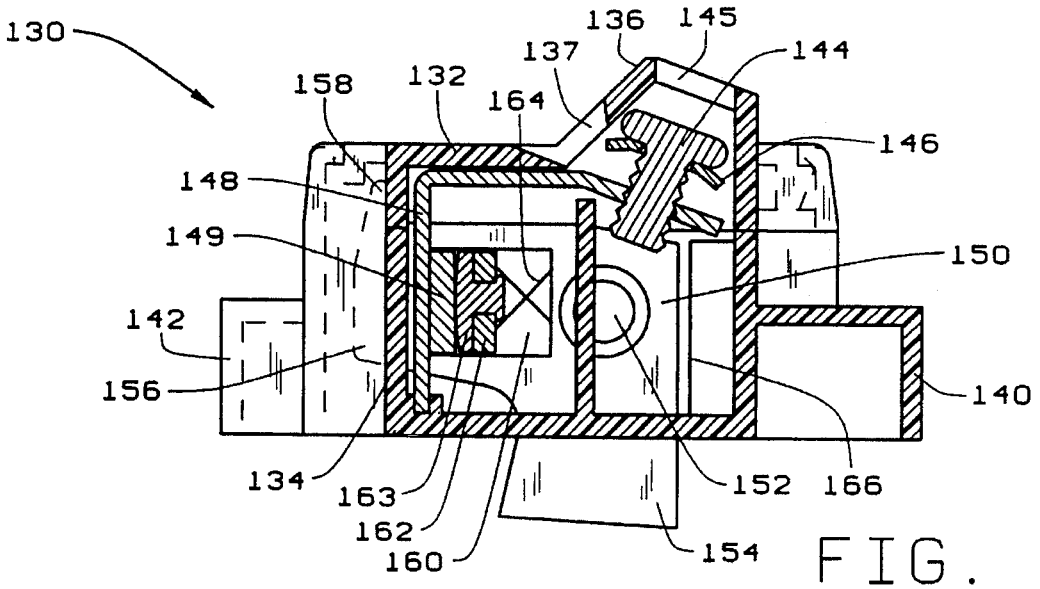
FIG. 11 is a sectional view of the modular switch of FIG. 10.
Figure 27:
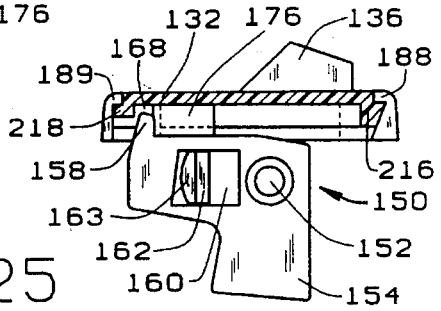
FIG. 27 is a sectional view of the upper housing portion taken along line 27—27 of FIG. 22 showing the contact carrier and movable contact disposed therein.
Figure 28:
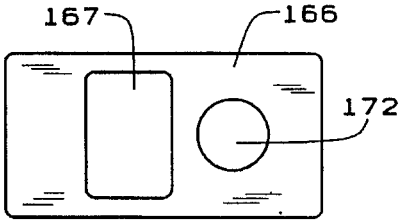
FIG. 28 is an enlarged side view of the slider plate in accordance with the present invention.
Figure 29:
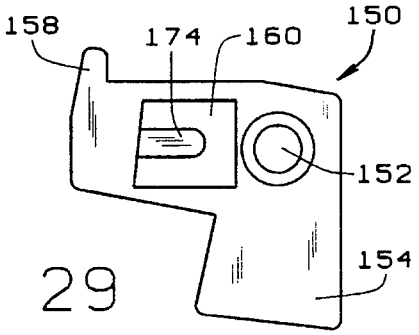
FIG. 29 is an enlarged side view of the contact carrier according to the present invention.

Reference now being made to FIG. 11, a contact carrier 150 together with slide plates 166, 182 are slidingly disposed within both upper and lower housing members 132, 134. Contact carrier 150 is shown alone in FIG. 29 and is preferably fabricated from a plastic and includes a leg 154, two round pivot bosses, of which only one pivot boss 152 is shown, a rectangular opening 160 in which extends a finger 174, and an upwardly extending flange 158. Disposed on either side of contact carrier 150 is a slide or guide plate 166 of which only a small portion of one slide plate 166 is shown in FIG. 10. Referring to FIG. 28, the slide plate 166 is shown which is identical to slide plate 182. Essentially, slide plate 166 is rectangular in shape and of nominal thickness, fabricated preferably from a plastic. Slide plate 166 includes a round pivot bore or recess 172 and a rectangular opening 167. The pivot boss 152 of contact carrier 150 is pivotally disposed within recess 172, with one on either side of contact carrier 150. Opening 167 of slide plate 166 corresponds to rectangular opening 160 in contact carrier and is provided to permit movable contact 162 to transversely extend therethrough (see FIG. 30). Finger 174 extends through an opening (not shown) in movable contact 162 to thereby hold movable contact 162 in place. FIG. 27 depicts contact carrier 150 in the fully closed position relative to cam trace 176 and upper housing 132.

Referring back to FIG. 11, movable contact 162 with contact pad 163 is shown extending though opening 160. A spring 164 engages the rear of movable contact 162 and extends therefrom to contact carrier 150. Stationary contact 148 downwardly extends from the underside surface of upper housing 132 at one end and includes a contact pad 149. FIG. 11 depicts contact carrier 150 in a fully closed position wherein the wiping action has already taken place. Spring 164 maintains a resilient bias of movable contact 162 towards stationary contact 148 as contact carrier 150 continues to linearly and pivotably move.

Operation

The manner of operation of the present switch 130 will now be described with reference to FIGS. 12–17. Although switch 130 includes two stationary contacts disposed therein, one on either side of contact carrier 150 (reference FIG. 10) and an elongated, movable contact that extends transversely from contact carrier 150 (see FIG. 30) thus stretching from one stationary contact to the other stationary contact to complete the circuit when closed, FIGS. 12–17 only shows one side of contact. This is because the other side of contact and operation thereof are identical and simultaneous since movable contact 162 which is supported and carried by contact carrier 150, extends transverse to contact carrier 150 and the longitudinal direction of travel thereof.

Figure 12:
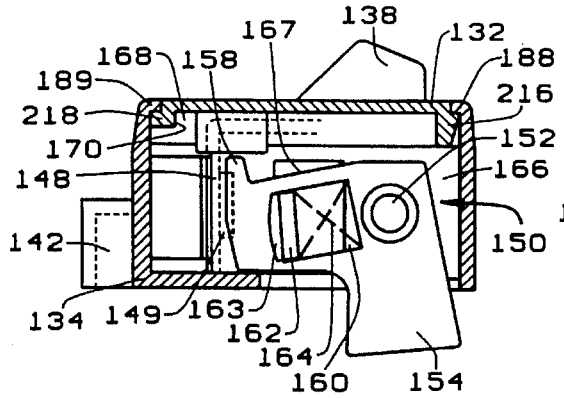
FIG. 12 is an enlarged partial sectional view of the modular switch of FIG. 10 depicted in the full open or initial non-contact position.

FIG. 12 shows contact carrier 150 in a fully open position. Leg 154 is slightly rearwardly angled as contact carrier 150 is slightly forwardly angled, but cam trace 176 keeps flange 158 of contact carrier 150 and thus the entire contact carrier 150 in the proper attitude. This allows contact carrier 150 to smoothly linearly travel within the housing. Movable contact 162 with contact pad 163 is forwardly biased within opening 160.

Figure 13:
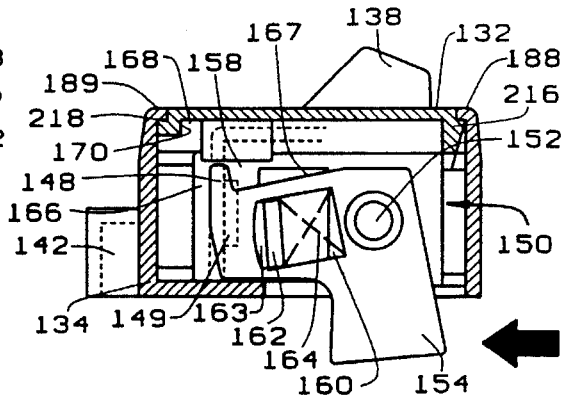
FIG. 13 is an enlarged partial sectional view of the modular switch of FIG. 10 depicting the contact carrier and movable contact in a mid-stroke position.

FIG. 13 depicts the initiation of forward movement as a result of a force exerted against the rear of leg 154 as indicated by the thick arrow. This is deemed the pre-travel stage before any contact between movable contact 162 and stationary contact 148. The motion of contact carrier 150 is linear, in that cam trace 176 (see FIG. 27) prevents any upwardly pivoting movement at this point. It should be noted that the guide plates, of which only one guide plate 166 is shown, linearly travels along with contact carrier 150. Thus as noted above, the entire contact assembly moves as force is exerted against leg 154.

Figure 14:
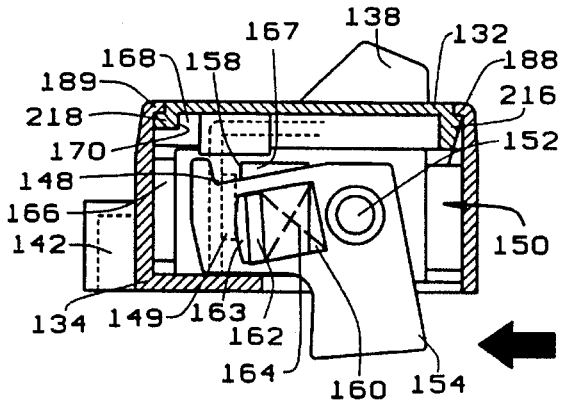
FIG. 14 is an enlarged partial sectional view of the modular switch of FIG. 10 depicting the contact carrier and movable contact in a first contact position.

FIG. 14 depicts the initial contact stage between contact pad 163 of movable contact 162 and contact pad 149 of stationary contact 148. At this point the top portion of contact pad 163 abuts the lower portion of contact pad 149.

Figure 15:
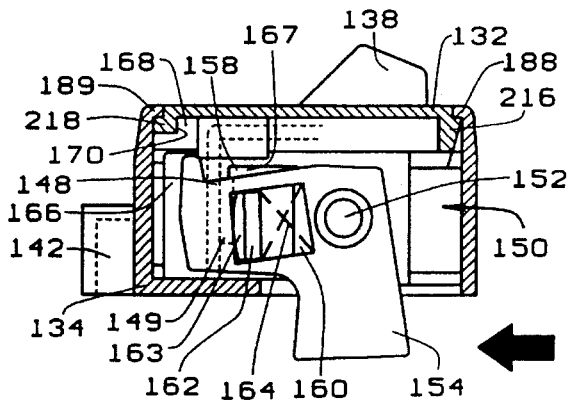
FIG. 15 is an enlarged partial sectional view of the modular switch of FIG. 10 depicting the contact carrier and movable contact in an initial wiping position.

FIG. 15 depicts the initial wiping of movable contact 162 and stationary contact 148 wherein the upper surface of contact pad 163 of movable contact 162 abuts the lower surface of contact pad 149 of stationary contact 148. At this point, contact carrier 150 has linearly traveled, while at the same time starting a 3° wipe of contact pad 149 of stationary contact 148 by contact pad 163 of movable contact 162.

Figure 16:
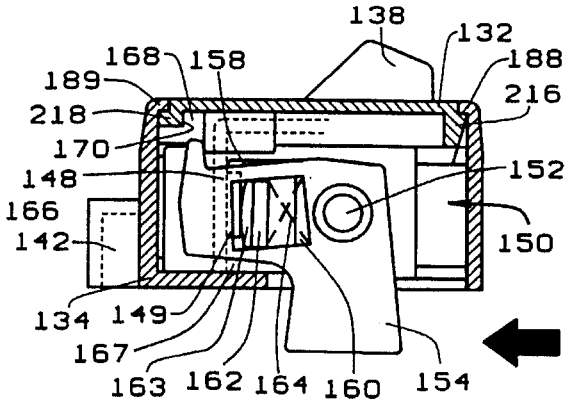
FIG. 16 is an enlarged partial sectional view of the modular switch of FIG. 10 depicting the contact carrier and movable contact in a continuing wiping position.

FIG. 16 depicts the continuation of the wiping action. Contact carrier 150 at this point has further linearly traveled.

Flange 158 has also reached the end of cam trace 176. Because of the off-center thrust applied to leg 154, contact carrier 150 tends to want to rotate or pivot about its pivot bosses 152. Previously, because flange 158 has abutted cam trace 176, contact carrier 150 could not pivot but was constrained to linear movement. Since pocket or recess 168 is at the end of cam trace 176, and flange 158 has reached that point, contact carrier 150 now starts to upwardly pivot upon continued application of off-center thrust. It is also at this point that guide plates 166 abut stop 170 and prevents any further linear travel of contact carrier 150. This preliminary pivoting causes an additional 3° wipe for a total of a 6° wipe. During this time, movable contact 162 cannot linearly travel any further, as it is abutting stationary contact 148. However, spring 164 compresses against movable contact 162 such that contact carrier 150 may continue its linear/pivotal travel.

Figure 17:
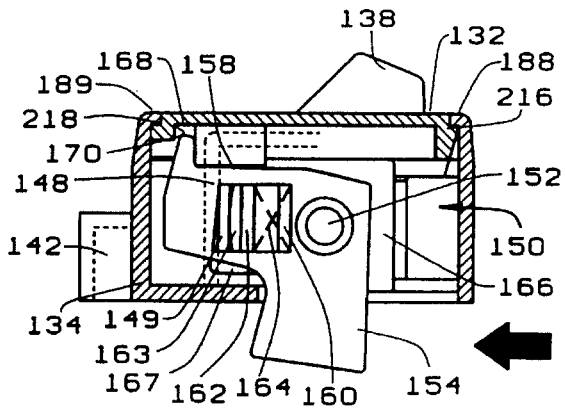
FIG. 17 is an enlarged partial sectional view of the modular switch of FIG. 10 depicting the contact carrier and movable contact in a fully closed position.
Figure 18:
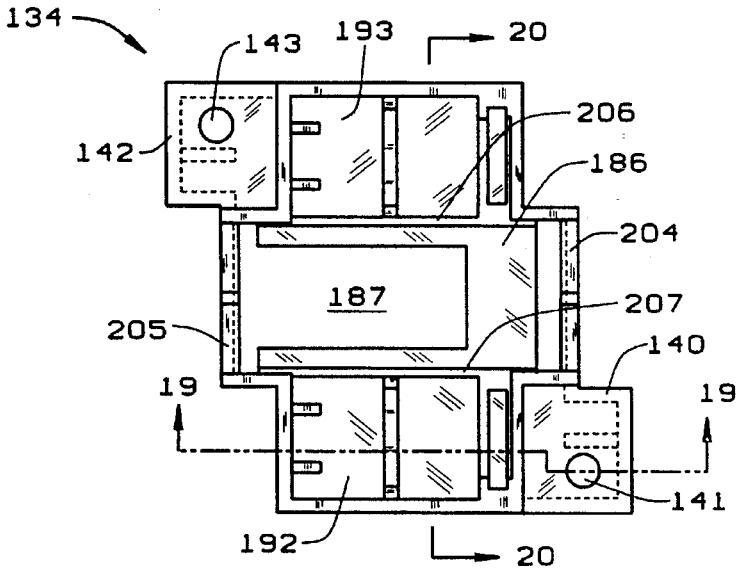
FIG. 18 is a top plan view of the lower housing portion of the modular switch of FIG. 10.

FIG. 17 depicts the final stage wherein contact carrier 150 is constrained against linear movement and must pivot under continued application of off-center thrust to leg 154. Contact carrier 150 travels another short linear distance before flange 158 fully enters recess 168 to abut the upper surface of recess 168 which then stops the pivoting of contact carrier 150. This motion causes a final 6° wiping action of contact pad 163 against contact pad 149 for a 12° total wipe.

Application of thrust in the reverse linear direction causes the contact carrier assembly to follow the reverse path of movement to that described above with reference to FIGS. 12–17. The reverse application of thrust creates a shearing action between contact pad 163 of movable contact 162 and contact pad 149 of stationary contact 148 to additionally wipe the contacts and unstick the contacts.

In the case of interlock assembly 100, as shown in FIGS. 5–8 and described hereinabove, actuator plate 104 acting through actuator rod 110 and cam 108, provides the external or off-center thrust for actuating modular switches 116*a–g* regardless of the orientation of the switches.

While the foregoing is directed towards the preferred embodiment of the present invention, other and further embodiments of the invention may be devised without departing from the basic scope thereof, and the scope thereof is determined by the claims which follow.

What is claimed is:

1. An electrical switch comprising:

a housing;

a stationary contact disposed in said housing;

a movable contact disposed in said housing;

a contact carrier that carries said movable contact into and out of electrical contact with said stationary contact, said housing defining a path of travel along which said contact carrier moves;

means for pivoting said contact carrier at a point of contact of said movable contact with said stationary contact to provide a wiping action between said movable contact and said stationary contact said pivoting means including:

a first guide plate adjacent one side of said contact carrier, said first guide plate including a first pivot recess;

a second guide plate adjacent another side of said contact carrier, said second guide plate including a second pivot recess;

a first pivot boss connected on said one side of said contact carrier and retained in said first pivot recess;

a second pivot boss connected on said another side of said contact carrier and retained in said second pivot recess; and a stop defined by said housing, said first and second guides movable along with said contact carrier, said stop limiting the linear movement of said contact carrier when said first and second guides abut said stop and causing said contact carrier to cease further linear movement and to pivot, said movable contact caused to transversely move relative the linear movement of said contact carrier to effect the wiping action of said movable contact against said stationary contact;

wherein said path of travel includes a cam trace defining a pocket, said contact carrier movably abutting said cam trace, said cam trace preventing said contact carrier from pivotal movement until said contact carrier reaches said pocket.

2. A modular electrical switch comprising:

a housing;

a stationary contact disposed within said housing;

a movable contact disposed within said housing;

a contact carrier at least partially disposed within said housing for carrying said movable contact into and out of contact with said stationary contact, said contact carrier including a first pivot boss disposed on one side, a second pivot boss disposed on another side, and an actuator leg extending from said housing for receiving an actuating force, said housing defining a linear travel path for said contact carrier; and means for pivoting said contact carrier at a point of contact of said movable contact with said stationary contact to provide a wiping action between said movable contact and said stationary contact, said means for pivoting including;

a first guide plate adjacent one side of said contact carrier, said first guide plate including a first pivot recess;

a second guide plate adjacent another side of said contact carrier, said second guide plate including a second pivot recess;

a first pivot boss connected on said one side of said contact carrier and retained in said first pivot recess;

a second pivot boss connected on said another side of said contact carrier and retained in said second pivot recess;

a stop defined by said housing, said first and second guides movable along with said contact carrier, said stop limiting the linear movement of said contact carrier when said first and second guides abut said stop and causing said contact carrier to cease further linear movement and to pivot, said movable contact caused to transversely move relative the linear movement of said contact carrier to effect the wiping action of said movable contact against said stationary contact;

a cam trace disposed on an inside upper surface of said housing within said path of travel and defining a pocket at one end thereof; and said cam trace preventing pivotal movement of said contact carrier until said first and second guides stop the linear movement of said contact carrier, said contact carrier then pivoting into said pocket to effect the wiping action.

3. The electrical switch of claim 2, wherein said housing includes mounting bosses for detachably securing said housing to a surface.

4. An electrical switch comprising:

a housing having an upper portion and a lower portion, said upper and lower portions joining at a horizontal plane;

a first stationary contact disposed in said housing;

a second stationary contact disposed in said housing and spaced from said first stationary contact;

a two-ended movable contact disposed in said housing;

a contact carrier movably disposed in said housing and adapted to carry said two-ended movable contact into and out of electrical engagement with said first and second stationary contacts to complete an electrical circuit therebetween, said contact carrier including a leg extending from said lower portion for receiving an actuating thrust, said housing defining a path of travel along which said contact carrier linearly moves;

means for pivoting said contact carrier after a point of contact of said two-ended movable contact with said first and second stationary contacts to effect a wiping action between said two-ended movable contact and said first and second stationary contacts, said pivoting means including a first and second boss integrally formed on opposite sides of said contact carrier, a first and second guide plate disposed on opposite sides of said contact carrier, said first and second guide plates respectively having a first and second pivot recess for receiving said first and second bosses such that said contact carrier is pivotally disposed thereon; and a cam trace disposed in said path of travel and formed in a lower surface of said upper portion, said cam trace defining a pocket at an end of said travel path and constraining said contact carrier from pivotal movement until said contact carrier has reached a predetermined travel distance;

said actuating thrust linearly moving said contact carrier along said path of travel such that said two-ended movable contact engages said first and second stationary contacts at said predetermined travel distance wherein said contact carrier ceases linear movement, said pocket then permitting said contact carrier to pivot to effect said wiping action between said two-ended movable contact and said first and second stationary contacts.

5. The electrical switch of claim 4, wherein said two-ended movable contact wipes said first and second stationary contacts for a 12° angle.

6. A switch assembly for controlling the operation of the doors and carriage for an industrial elevator, the switch assembly comprising:

a housing;

an actuator disposed in said housing, said actuator responsive to the position of the doors and carriage;

a plurality of replaceable modular electrical switches removably disposed in said housing, said switches coupled to and actuated by said actuator in order to make contact and break contact;

a cam operably coupled to said actuator; and an actuator rod operably coupled to said cam, said actuator rod being rotatable in response to the position of the carriage and the doors such that said cam is pivotable by and about said actuator rod, said pivotable movement of said cam in response to movement of said actuator rod causing said actuator to longitudinally move to open and close said switches;

said modular switches may be oriented within said housing to be either normally open or normally closed.

7. A switch assembly for controlling the doors and carriage of a freight elevator, the switch assembly comprising:

an elongated housing;

an elongated actuator plate movably disposed within said housing;

a pivot operably connected to said freight elevator and to said actuator plate and adapted to limitedly move said actuator plate in response to elevator carriage and door movement and position; and a plurality of modular electrical switches each independently removably secured adjacent to and operably coupled with said actuator plate, each said modular switch including:

a switch housing having an upper portion and a lower portion, said upper and lower portions joining at a horizontal plane;

a first stationary contact disposed in said switch housing;

a second stationary contact disposed in said switch housing and spaced from said first stationary contact;

a two-ended movable contact disposed in said switch housing; a contact carrier movably disposed in said switch housing and adapted to carry said two-ended movable contact into and out of electrical engagement with said first and second stationary contacts to complete an electrical circuit therebetween, said contact carrier including a leg extending from said lower portion for receiving an actuating thrust and engaged with said actuator plate, said switch housing defining a path of travel along which said contact carrier linearly moves;

means for pivoting said contact carrier after a point of contact of said two-ended movable contact with said first and second stationary contacts to effect a wiping action between said two-ended movable contact and said first and second stationary contacts, said pivoting means including a first and second boss integrally formed on opposite sides of said contact carrier, a first and second guide plate disposed on opposite sides of said contact carrier, said first and second guide plates respectively having a first and second pivot recess for receiving said first and second bosses such that said contact carrier is pivotally disposed thereon; and a cam trace disposed in said path of travel and formed in a lower surface of said upper portion, said cam trace defining a pocket at an end of said travel path and constraining said contact carrier from pivotal movement until said contact carrier has reached a predetermined travel distance;

said actuating thrust linearly moving said contact carrier along said path of travel such that said two-ended movable contact engages said first and second stationary contacts at said predetermined travel distance wherein said contact carrier ceases linear movement, said pocket then permitting said contact carrier to pivot to effect said wiping action between said two-ended movable contact and said first and second stationary contacts.

* * * * *